US009517395B1

(12) United States Patent
Giantinoto

(10) Patent No.: US 9,517,395 B1
(45) Date of Patent: Dec. 13, 2016

(54) PUTTING TARGET

(71) Applicant: Anthony Giantinoto, Wilmington, DE (US)

(72) Inventor: Anthony Giantinoto, Wilmington, DE (US)

( * ) Notice: Subject to any disclaimer, the term of this patent is extended or adjusted under 35 U.S.C. 154(b) by 0 days.

(21) Appl. No.: 14/922,286

(22) Filed: Oct. 26, 2015

(51) Int. Cl.
*A63B 57/00* (2015.01)
*A63B 69/36* (2006.01)
*A63B 63/00* (2006.01)

(52) U.S. Cl.
CPC ..... *A63B 63/007* (2013.01)

(58) Field of Classification Search
USPC ..... 473/173, 174, 179, 180, 185, 188, 189, 473/195, 196
See application file for complete search history.

(56) References Cited

U.S. PATENT DOCUMENTS 3,891,221 A * 6/1975 Gordon ..... A63B 63/00 273/456
4,906,006 A * 3/1990 Sigunick ..... A63B 57/357 473/179
5,435,560 A * 7/1995 Kehoe ..... A63B 63/007 473/174
5,779,567 A * 7/1998 Durso ..... A63B 57/357 473/176
6,419,590 B1 * 7/2002 Criger ..... A63B 63/007 473/174
2003/0190970 A1 * 10/2003 Patterson ..... A63B 69/3676 473/174

* cited by examiner

*Primary Examiner* — Nini Legesse

(57) ABSTRACT

An embodiment of a putting target (10) whereby a golf ball is caught utilizing a hydrogel section (16) that is affixed to a section of magnetic sheeting (12). The hydrogel section (16) provides an adhesive catch area so that a golf ball can be effectively caught with its surface. Alternate embodiments of a hydrogel section (16) affixed to magnetic sheeting (12) can be useful in various fields for activities or procedures that require the temporary adherence of a tool, device, decoration, etc., to a magnetic surface.

1 Claim, 8 Drawing Sheets

PUTTING TARGET

FIELD

This embodiment relates to golf practice accessories, specifically to training aids and devices used as golf putting targets.

BACKGROUND

There are a wide variety of putting targets that have been conceived for the purpose of practicing the putting of a golf ball. The basic premise is to give the golfer a target to direct their efforts towards. Some putting targets catch the ball in a cup. Some putting targets catch and quickly return the ball to the operator. The putting targets are usually discs or cups that provide a basic representation of a standard golf hole. More elaborate targets employ artificial grass mats that surround or lead up to the golf cup.

These previous designs tend to be either bulky, or require the ball to overcome a prominent outer edge prior to entering the golf target. Putting mats usually need to be rolled up if there is no dedicated space. Putting targets with prominent outer edges tend to be too bulky for easy transport or inconspicuous storage. The prominent outer edge or incline surrounding the golf target adds an unrealistic variable to the golfers experience. What is needed is a lightweight device that stores flat, can be inconspicuously transported, and offers no prominent outer edge or incline to disrupt the movement of the ball into the putting target. The target should give an accurate visualization of a standard golf hole. The target's surface should have the ability to effectively catch a golf ball from any angle. The putting target should be able to be displayed as an option for practice or leisure.

SUMMARY

In accordance with this embodiment of a putting target, the base layer is composed of flexible magnetic sheeting that is well known and commonly used in conjunction with a printable substrate. The substrate is there to display graphics and written information. The material properties of the magnetic sheeting provide a semi-rigid base for the target, as well as the ability to cling to any magnetic surface. The additional component of magnetic attraction to surfaces such as file cabinets, lockers, refrigerators, and metal doors, provides multiple storage and display options. The target can be displayed in a conspicuous area, such as on an athletic locker or break-room refrigerator, to alert or remind others that it is an option for leisure or practice. The target can also be placed in a less conspicuous setting, such as on a hidden side of a file cabinet. The minimal thickness of the magnetic sheeting provides limited resistance to a ball crossing its surface and allows the target to be stored flat. The lightness of the magnetic sheeting allows the putting target to be easily transported. Any adornment or information can be applied directly to the printable substrate without adding any additional bulk or thickness to the putting target. The common thickness of the magnet sheeting is approximately 30 mils, but can vary in thickness (up to approximately 60 mils) and still function as an applicable base layer. The thickness of the magnetic sheeting can be varied for alternate embodiments where edge thickness is not a consideration. Also the size of the magnetic sheeting and strength of magnetism can be varied to suit alternative applications. For this embodiment, the printable substrate of the magnetic sheeting will contain the graphical depiction of a standard golf cup. The product name and minimal product information will also be represented within the graphic. Product information and the dimensions of the graphic can be altered for various purposes or subsequent models.

The second layer of this embodiment utilizes a well-known transparent dermal fastener gel, which is also referred to as a hydrogel. Hydrogels were designed and formulated to adhere a product to the skin. For this embodiment, the hydrogel will adhere the magnetic sheeting to an object, specifically a golf ball. The transparent hydrogel includes two usable sides with different predetermined adhesive properties. The first side (tie-side) has an anchoring adhesive that provides a strong attachment to the printable substrate of the magnetic sheeting.

The second side (catch-side) has an adhesive predetermined for the temporary adherence of an object. This catch-side of the hydrogel provides a "quick-grab" function. It is also formulated to provide an "easy-release" of a golf ball or object from the hydrogel surface. The catch-side of the hydrogel demonstrates excellent re-stick capabilities. This allows the target to function effectively as a golf ball "catching" device. The adhesive capabilities of hydrogels can be variable. Ample testing was required to choose the correct series of hydrogel to suit the functionality of the target. For this embodiment, the series of hydrogel has been chosen to function in accordance with the physical dimensions and typical mechanics of a standard golf ball. The hydrogel is cut to a specific size in this embodiment for two reasons: firstly, to match the dimensions of a standard golf cup opening; secondly, to provide for an exposed area on the target's base to assist in the removal of a "caught" golf ball. A golf ball that adheres to the hydrogel is removed by applying downward pressure on the outer edge portion of the magnetic sheeting's printable substrate (grip-ring) while manually removing the ball. Downward pressure can be applied with the putter-head, a finger or toe, or any other convenient object. A golf ball can also be removed from the hydrogel by using slight downward pressure with a foot or hand while rolling the ball across the target's surface. The inherent properties of the chosen hydrogel leave no obvious residue on the golf ball surface. A transparent hydrogel has been purposely selected to preserve the visualization of the underling adornment. The hydrogel is very thin and its entire top surface, including the edges, demonstrates adhesive qualities. For this reason, the second layer contributes no additional structural thickness to the embodiment.

The third layer of this embodiment is a well-known release liner. The release liner is a thin and transparent plastic with non-stick characteristics. This layer is used to both protect and preserve the integrity of the hydrogel's adhesive qualities. It is removed and retained when the putting target is being used, and replaced when it is not. The release liner is cut larger than the size of the hydrogel to make it easy for the operator to peel it off the target's catch-side surface. The transparent aspect of the release liner preserves the visualization of the golf cup graphic.

The above specifications are what I presently contemplate for this embodiment, but other applications, product dimensions, and variability can be envisioned. For example, I presently contemplate that this embodiment may have applications in other fields such as the military, law enforcement, government, corporate, aeronautics, household, athletic, entertainment, restaurant, retail, professional, mechanical, industrial, medical and/or technical. An activity or procedure that requires the temporary adherence of a tool, device, decoration, etc., to a magnetic surface is a contemplated embodiment. Magnetic sheeting size, magnetic strength, and the use of other flat body materials for the base layer are contemplated variables of an alternate embodiment. Hydrogel section size, predetermined hydrogel adhesive qualities, and the application of alternative adhesive polymers to the base layer are also contemplated variables of an alternate embodiment. These variables can be arranged in accordance with a multitude of specifications.

DRAWINGS

Reference Numbers

| | |
|---|---|
| 10 | putting target |
| 12 | magnetic sheeting (layer 1) |
| D12 | predetermined diameter (layer 1) |
| H12 | predetermined height (layer 1) |
| 14 | release liner (layer 3) |
| D14 | predetermined diameter (layer 3) |
| H14 | predetermined height (layer 3) |
| 16 | hydrogel section (layer 2) |
| D16 | predetermined diameter (layer 2) |
| H16 | predetermined height (layer 2) |
| 18 | printable substrate (layer 1) |
| 20 | catch-base (layer 2 affixed to layer 1) |
| 22 | grip-ring |
| 24 | magnetized surface (layer 1) |
| 26 | tie-side (layer 2) |
| 28 | catch-side (layer 2) |

DETAILED DESCRIPTION OF THE EMBODIMENT

The following descriptions are representative of the embodiment set forth in this application.

This embodiment is of a putting target.

Figure 1:
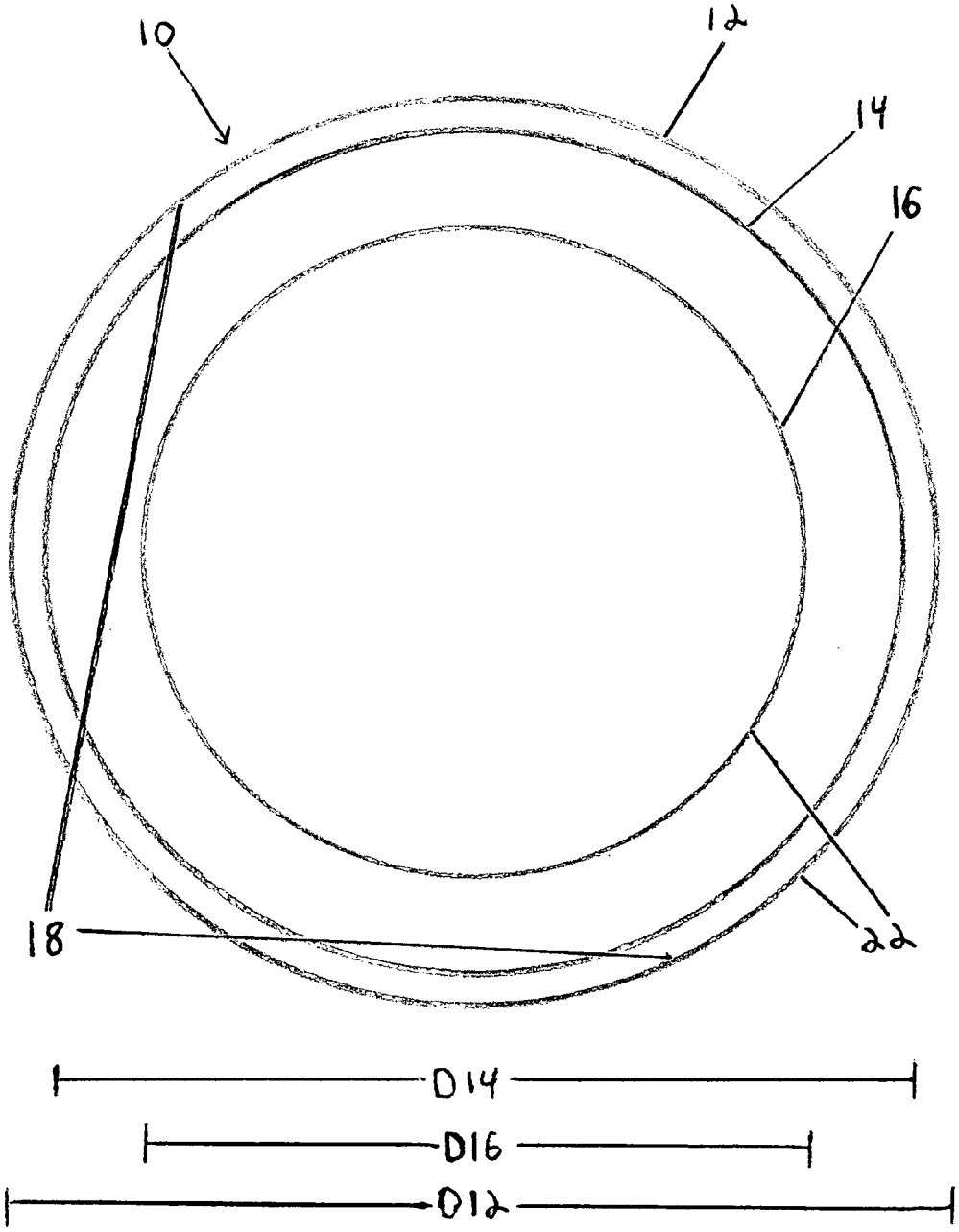
FIG. 1 is a top view of the embodiment in its entirety.
Figure 3:
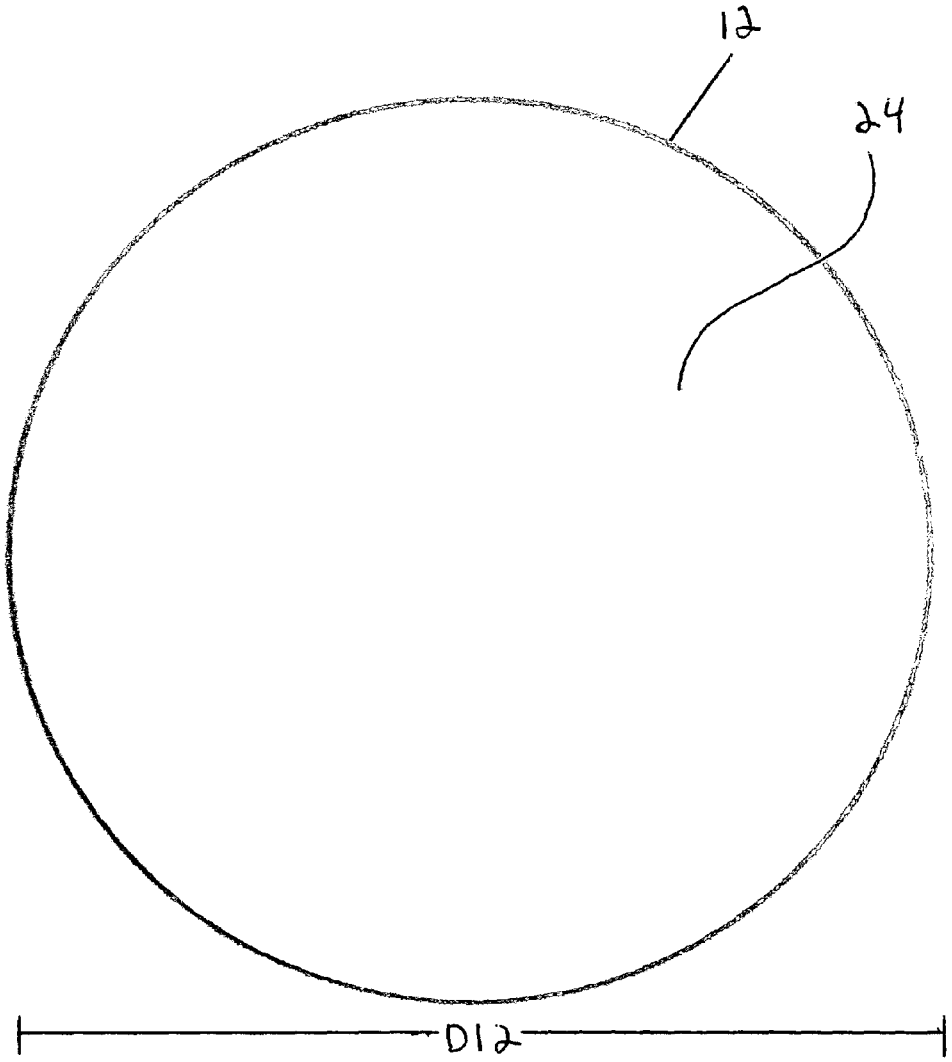
FIG. 3 is a bottom view of the magnetic sheeting's magnetized surface (layer 1).

FIG. 1 shows a top view of the putting target 10. The putting target 10 is a combination of three distinct layers. The magnetic sheeting (layer 1) 12 has two sides. The topside is a printable substrate 18 (also see FIG. 4) and the bottom side is a magnetized surface 24 (FIG. 3). The magnetic sheeting (layer 1) 12 has a predetermined diameter D12. The hydrogel section (layer 2) 16 also has two sides. The tie-side 26 (FIG. 5) attaches the hydrogel section 16 to the printable substrate 18 of the magnetic sheeting 12. The catch-side 28 (FIG. 6) is left exposed to catch a golf ball on its surface. The catch-side 28 (FIG. 6) is covered with the release liner 14 when the target is not being used. The hydrogel section (layer 2) 16 has a predetermined diameter D16. The release liner (layer 3) 14 has a predetermined diameter D14. The printable substrate 18 has a section that extends from the outer edge of the hydrogel section 16 to the outer edge of the magnetic sheeting 12 and is referred to as the grip-ring 22.

Figure 2:
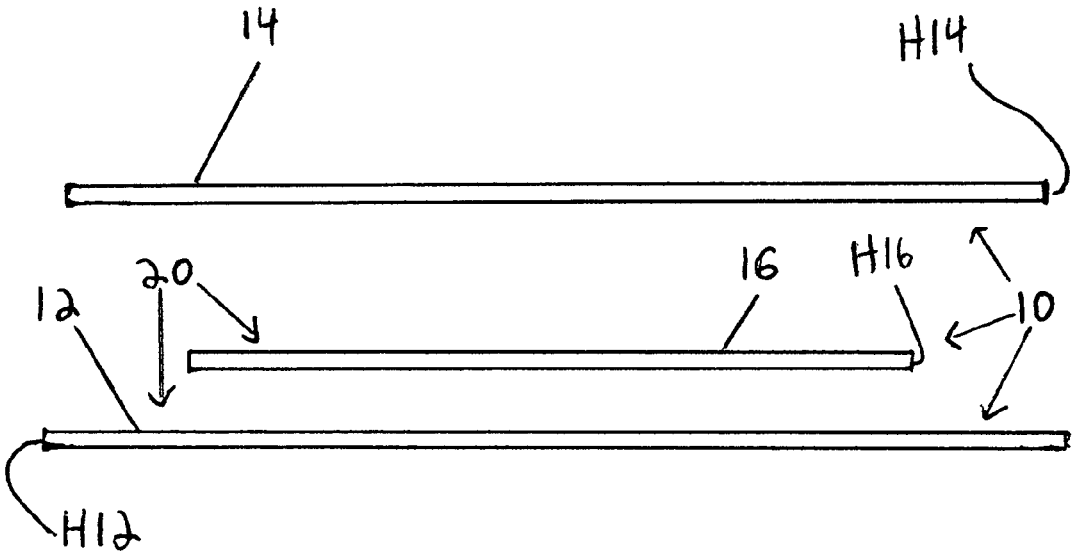
FIG. 2 is a side view of the embodiment in its entirety.

FIG. 2 shows a side view of the putting target 10. The putting target 10 is comprised of the magnetic sheeting 12, the hydrogel section 16, and the release liner 14. The hydrogel section 16 is permanently affixed to the magnetic sheeting 12. Together they comprise the catch-base 20. The release liner 14 has predetermined characteristics that allow it to be attached and removed from the hydrogel section 16. The release liner 14 has a predetermined height H14. The hydrogel section 16 has a predetermined height H16. The magnetic sheeting 12 has a predetermined height H12.

FIG. 3 shows the magnetic sheeting 12 with its magnetized surface 24 exposed. The magnetic sheeting 12 has a predetermined diameter D12. The magnetized surface 24 provides predetermined magnetic adherence properties so that the putting target 10 (FIG. 1) can be stored or displayed on any magnetic surface.

Figure 4:
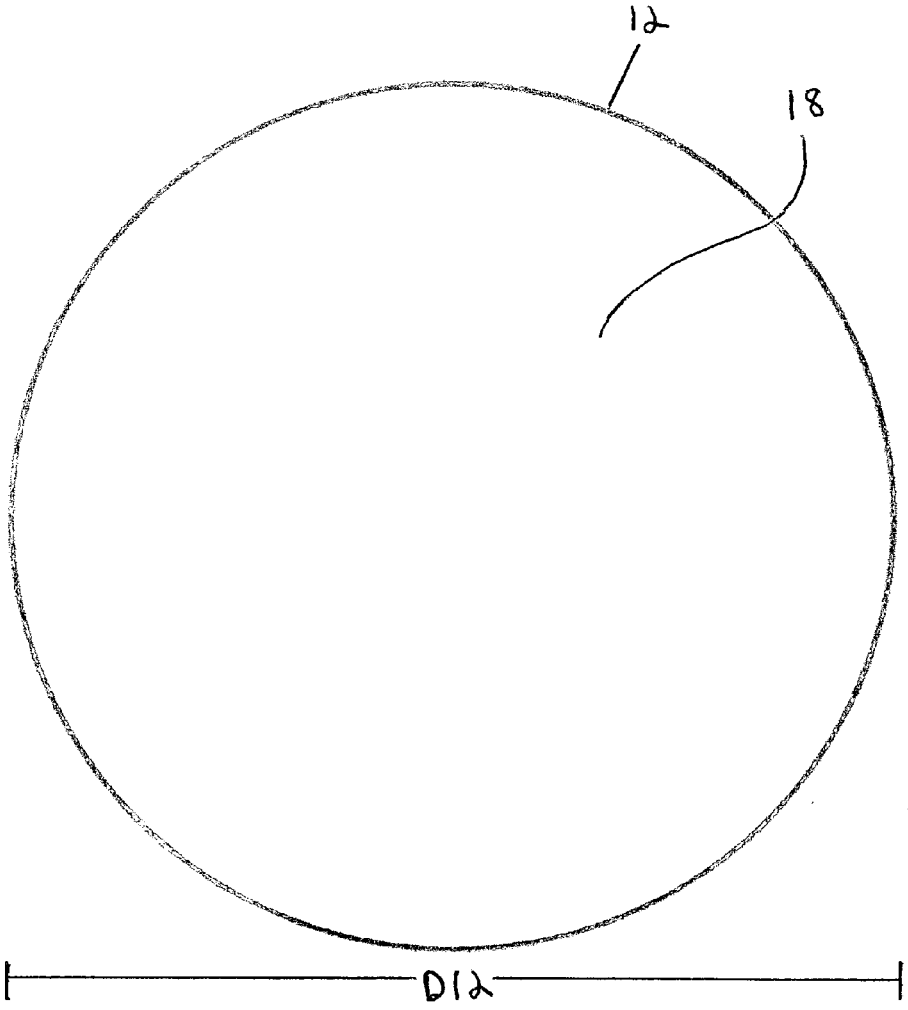
FIG. 4 is a top view of the magnet sheeting's printable substrate (layer 1).

FIG. 4 shows the magnetic sheeting 12 with the printable substrate 18 exposed. The printable substrate 18 has a predetermined diameter D12 substrate. will be. The tie-side 26 (FIG. 5) of the hydrogel section 16 (FIG. 5) attaches directly to the printable substrate 18.

Figure 5:
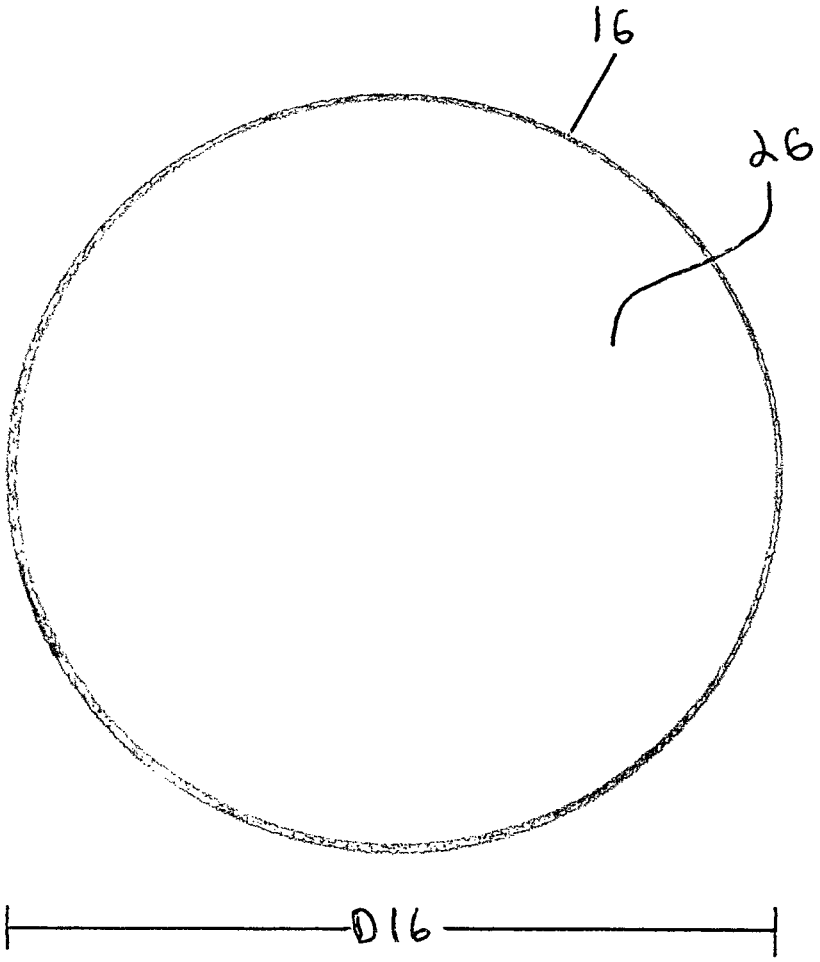
FIG. 5 is a bottom view of the hydrogel section's tie-side (layer 2).

FIG. 5 shows the hydrogel section 16 with a view of the tie-side 26. The hydrogel section 16 has a predetermined diameter D16. The tie-side 26 is affixed to the printable substrate 18 (FIG. 4) of the magnetic sheeting 12 (FIG. 4). The hydrogel section 16 is transparent to allow for the visualization of the printable substrate 18 (FIG. 4). The tie-side 26 has predetermined adhesive properties that allow it to securely attach to the magnet sheeting 12 (FIG. 4).

Figure 6:
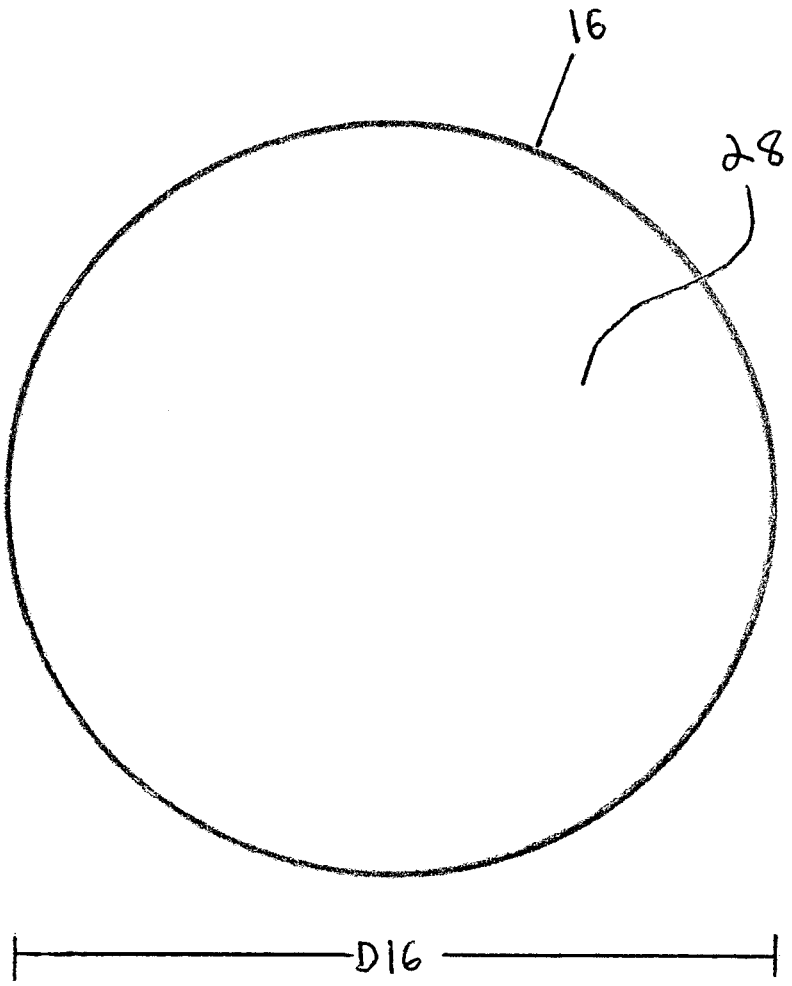
FIG. 6 is a top view of the hydrogel section's catch-side (layer 2).
Figure 7:
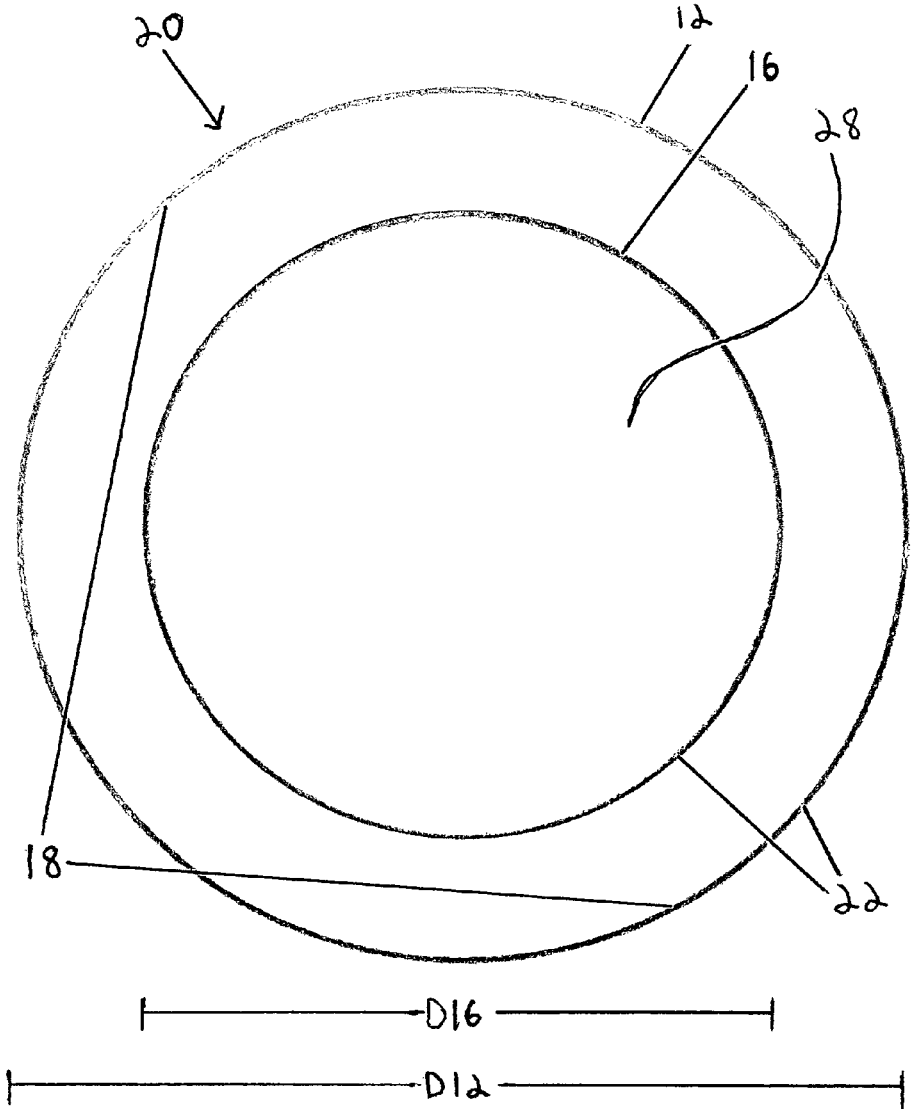
FIG. 7 is a top view of the catch-base (layer 2 affixed to layer 1).

FIG. 6 shows the hydrogel section 16 with a view of the catch-side 28. The hydrogel section 16 has a predetermined diameter D16. The catch-side 28 has predetermined adhesive properties so that it can catch a golf ball when it contacts or crosses its surface. The catch-side 28 has a predetermined surface adhesion that allows for easy removal of a golf ball from the catch-base 20 (FIG. 7). The catch-side 28 has predetermined re-stick properties that allow for repetitive use of the catch-base 20 (FIG. 7). The catch-side 28 has a combination of predetermined characteristics that allow it to function as a putting target 10 (FIG. 1). The catch-side 28 adheres to the release liner 14 (FIG. 8) when the putting target 10 (FIG. 1) is not in use. The hydrogel section 16 is transparent to allow for the visualization of the printable substrate 18 (FIG. 4).

FIG. 7 shows a top view of the catch-base 20. The release liner 14 (FIG. 8) has been removed. The catch-base 20 has a predetermined diameter D12. The hydrogel section 16 is affixed with its tie-side 26 (FIG. 5) to the printable substrate 18 of the magnetic sheeting 12. The printable substrate 18 has a section that extends from the outer edge of the hydrogel section 16 to the outer edge of the magnetic sheeting 12 and is referred to as the grip-ring 22. The grip-ring 22 is an area of exposed printable substrate 18 that assists in the removal of a golf ball from the catch-side 28. Pressure is applied to the grip-ring 22 simultaneously as the ball is pulled or rolled free from the catch-side 28. The grip-ring 22 also assists in the removal of the release liner 14 (FIG. 8) from the catch-side 28 of the hydrogel section 16. The hydrogel section has a predetermined diameter D16.

Figure 8:
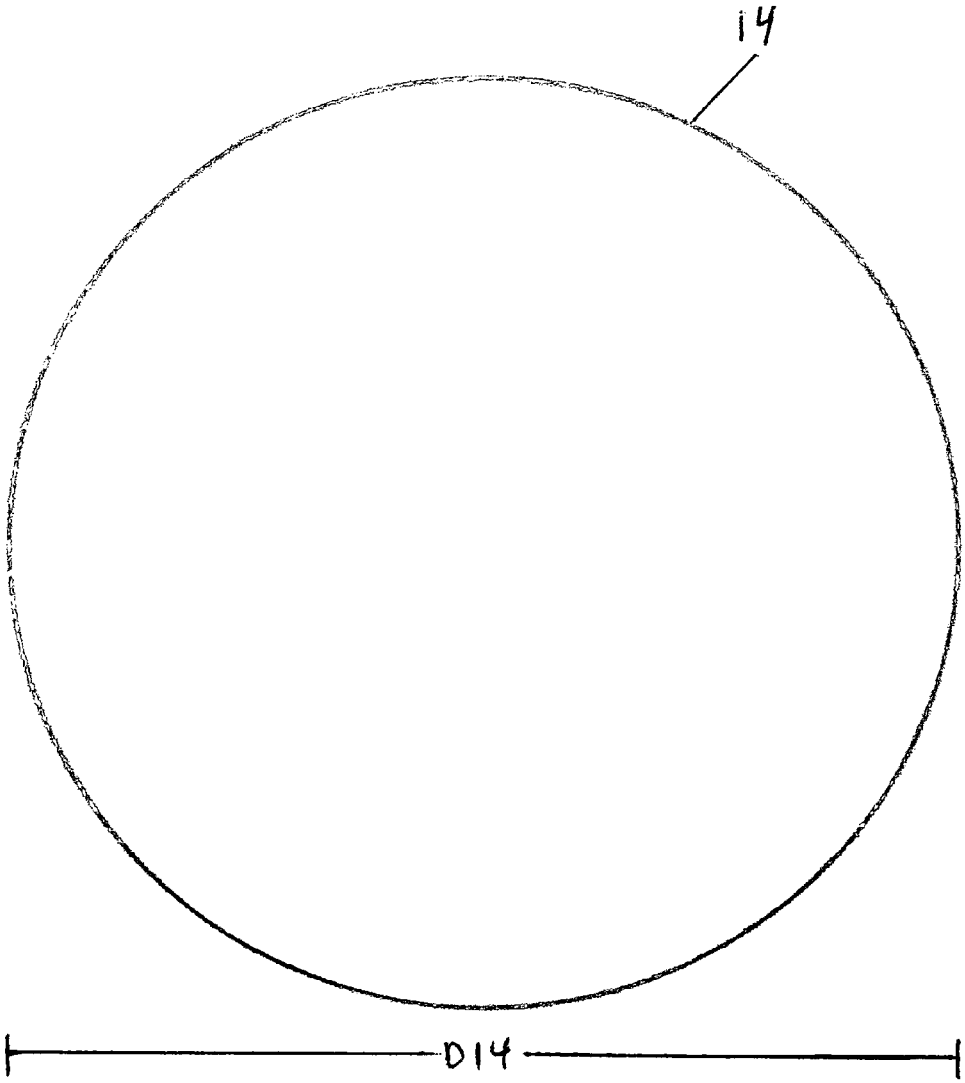
FIG. 8 is a top view of the release liner (layer 3). (The top and bottom view of layer 3 are identical in material, clarity, form and function and are shown as one image.)

FIG. 8 shows an overhead view of the release liner 14. The release liner 14 has a predetermined diameter D14. The release liner 14 is composed of a transparent plastic material with predetermined characteristics. These characteristics allow the release liner 14 to be easily removed from the catch-base 20 (FIG. 7). The release liner 14 protects and preserves the predetermined adhesive qualities of the catch-side 28 (FIG. 7). The release liner 14 is re-attached to the catch-base 20 (FIG. 7) when the putting target 10 (FIG. 1) is not being used. The release liner 14 is transparent to preserve the visualization of the printable substrate 18 (FIG. 4). The top and bottom view of the release liner 14 are identical in structure and function.

What is claimed is:

1. A putting target device whereby a golf ball is caught by a hydrogel affixed to magnetic sheeting, comprising:

a. a transparent hydrogel section permanently affixed to a magnetic sheeting, b. said magnetic sheeting is a printable substrate that contains a graphical depiction of a golf cup, c. said transparent hydrogel section is affixed at the center and over said printable substrate, d. said transparent hydrogel section capable of catching a golf ball as it crosses a putting target's surface on a ground, e. an exposed area of said printable substrate surrounding said transparent hydrogel section assists in the removal of said golf ball, f. said magnetic sheeting provides magnetic surface adherence, g. said magnetic sheeting provides product rigidity, h. a transparent release liner to cover and protect said transparent hydrogel section, i. said transparent release liner maintains the visibility of said printable substrate, j. said transparent release liner is larger than said transparent hydrogel section, k. wherein the target is flat, light weight, capable of effectively catching a golf ball from any angle, and wherein the target has no prominent outer edge or incline that could disrupt the movement of a golf ball.

* * * * *